United States Patent [19]

Ohashi et al.

[11] 4,447,685

[45] May 8, 1984

[54] SMALL-SIZED PUSH-BUTTON SWITCH

[75] Inventors: Shigeo Ohashi; Tadashi Nakamura; Koji Kamisada, all of Tokyo, Japan

[73] Assignee: Nihon Kaiheiki Kogyo Kabushiki Kaisha, Tokyo, Japan

[21] Appl. No.: 425,367

[22] Filed: Sep. 28, 1982

[30] Foreign Application Priority Data

Feb. 28, 1982 [JP] Japan ..... 57-27622[U]
Feb. 28, 1982 [JP] Japan ..... 57-27623[U]

[51] Int. Cl.[3] ..... H01H 13/46

[52] U.S. Cl. ..... 200/67 D; 200/153 J; 200/314

[58] Field of Search ..... 200/67 A, 67 D, 159 A, 200/153 LA, 153 J, 314

[56] References Cited

U.S. PATENT DOCUMENTS

| | | | |
|---|---|---|---|
| 2,583,756 | 1/1952 | Wahlberg | 200/67 D |
| 3,437,775 | 4/1969 | Piber | 200/314 |
| 3,542,988 | 11/1970 | Baldasare | 200/153 J |
| 3,602,663 | 8/1971 | Jones | 200/67 B |
| 3,624,323 | 11/1971 | Borgmann | 200/67 D |
| 3,626,132 | 12/1971 | Jungels | 200/67 D |
| 4,249,055 | 2/1981 | Matsuo | 200/159 A |
| 4,357,589 | 11/1982 | Payne | 200/67 B |
| 4,398,075 | 8/1983 | Vogel | 200/67 A |

FOREIGN PATENT DOCUMENTS

| | | | |
|---|---|---|---|
| 1145689 | 3/1963 | Fed. Rep. of Germany | 200/159 A |
| 1089484 | 11/1967 | United Kingdom | 200/159 A |

*Primary Examiner*—John W. Shepperd
*Attorney, Agent, or Firm*—Lawrence I. Field

[57] ABSTRACT

Disclosed herein is a small-sized push-button switch in which a switching operation is made by depressing a push-button to cause a plunger provided at the lower portion of the push-button to move vertically. The switch mechanism provided within the switch comprises a switch base, an upwardly extending arm having its fulcrum on the switch base and being swung about the fulcrum by the plunger, fixed contacts and movable contacts longitudinally or axially provided on the switch base, and a resilient piece bridged between the other end of the arm and the movable end of the movable contact. At least one switch mechanism is inserted into and mounted on a switch body through a switch auxiliary base. The switch mechanism is disposed relative to the plunger so that the operating direction of the plunger is located at right angles to the switch operating directions of the movable contact relative to the fixed contacts. That is, all the plunger, the movable contact and the fixed contacts are disposed longitudinally or axially.

9 Claims, 5 Drawing Figures

FIG. 3a
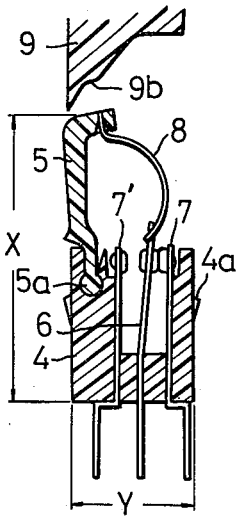
FIG. 3b
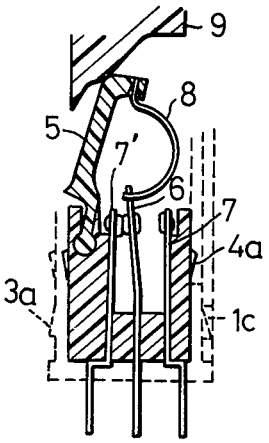
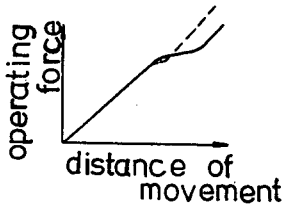
FIG. 3c
FIG. 4a
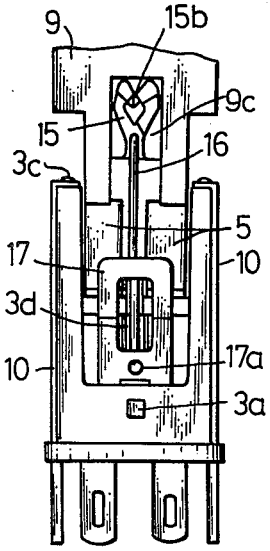
FIG. 4b
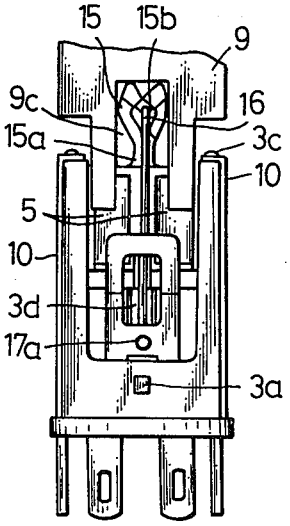

SMALL-SIZED PUSH-BUTTON SWITCH

BACKGROUND OF THE INVENTION

This invention generally relates to a small-sized push-button switch. More particularly, the present invention relates to a small-sized push-button switch in which the outer diameter of the switch is made small by arranging the direction of movement of switch contact at right angles to the operating direction of the push-button.

In a conventional push-button switch, movable contact and fixed contacts are disposed substantially perpendicularly or laterally relative to the operating direction (longitudinal direction) of the push-button or the plunger. In other words, the operating direction of the push-button or the plunger and the engagement operating direction of the movable contact relative to the fixed contacts are disposed in the same direction or longitudinally. Therefore, the lateral width or outer diameter of the switch naturally becomes large, which prevents the switch from being made small.

Furthermore, conventionally, a momentary type of switch has been converted into an alternate type of switch by providing a so-called heart cam on the momentary type of switch. However, in conventional switches of this type, in construction, it is necessary to insert into the heart cam a hook pin for temporarily locking the movement of the plunger each time a switching operation is made through engagement of the hook pin to the heart cam, by use of special means, and therefore it is difficult to assemble the switch and to make an alternation of switch types.

SUMMARY OF THE INVENTION

The present invention is made in view of the foregoing, and it is an object of the invention to provide a novel small-sized push-button switch which can eliminate the above-mentioned disadvantages by disposing a movable contact and fixed contacts and an operating direction of a plunger longitudinally, and can be made to be simple in construction and provide a smooth or good switching operation.

It is another object of the present invention to provide a novel small-sized push-button switch in which manufacturing steps can be greatly simplified by automatically inserting a hook pin into a heart cam and simultaneously it is easier to make an alternation of switching functions.

In order to accomplish the foregoing, there is provided a small-sized push-button switch which comprises at least one switch mechanism, each including a movable contact, fixed contacts disposed on opposite sides of the movable contact, a switch base for holding the lower portions of the movable contact and fixed contacts, an arm extending upwardly and being swung about one side portion of the switch base as a fulcrum and a resilient piece provided between the arm and the movable contact, a switch auxiliary base for holding the switch mechanism therein and a plunger having a push-button provided at the top end thereof and disposed on the arm so that the inclined surface of the plunger is slidable on the outer top surface of the arm, said plunger causing the arm to be swung in a direction by depression of the push-button and causing the movable contact to be moved in the other direction due to the action of the resilient piece whereby a switching operation is made, and the direction of movement of the plunger, the movable contact and fixed contacts being disposed vertically.

In accordance with the present invention, since the microswitch mechanism (or the movable contact and fixed contacts) are made to be in the same direction as that of operation of the plunger, which is different from combination of the conventional push-button switch, the outer diameter or lateral width of the switch can be made comparatively small since X is smaller than Y as shown in FIG. 3. According to the embodiment, the lateral width can be made to be smaller at least 50% less than that of the conventional one. Furthermore, since the arm of the microswitch is adapted to be slidable on the inclined surface of the plunger, the push-button switch having a very smooth operation can be obtained.

In accordance with the present invention, since the switch body, the switch auxiliary base and the switch base are mounted due to their projection-aperture relationship by one-touch mounting, it is simple to assemble them.

Moreover, since the arm of the microswitch is adapted to be slidable on the inclined lower surface of the plunger, a push-button switch which is operated very smoothly can be obtained.

Furthermore, in accordance with the present invention, since the switch body, the switch auxiliary base and the switch base can be attached with one another in projection-aperture relationship it is very simple to assemble the switch.

In addition, since all the plunger, the lamp holder and the push-button are adapted to be longitudinally fitted to one another, and these members can be incorporated merely by pushing them, it is very simple to assemble the switch and can be made effective.

Another feature of the present invention resides in that the movement of the switch mechanism after the switch is switched over can be made to be one which does not almost force the switch mechanism since the switch base on which the movable contact, the fixed contacts and the arm for actuating the movable contact is longitudinally disposed and in addition the plunger having the inclined surface for actuating the switch mechanism of the switch base are disposed in the same direction or longitudinally, or since the rate of variation of the upper switch mechanism to the vertical movement or vertical stroke of the plunger in relatively small. This generates a feature that the life of the switch can be maintained to be long in spite of a small-sized switch mechanism.

In accordance with the present invention, although the switch mechanism which comprises a switch base, an arm, a movable contact, fixed contact and a resilient piece constitutes a circuit, a switch of one circuit or more than two circuits can be easily selected by attaching one or more switch mechanisms to the auxiliary base. In addition, since in spite of a plurality of switch mechanisms, one block can be formed by attaching these switch mechanisms to the auxiliary base, their assembly and maintenance are very simple.

Furthermore, in accordance with the present invention, since the terminals of the fixed contacts of the switch mechanism are outwardly folded along the bottom surface of the switch base so as to be spaced away from the terminal of the movable contact, distances between contacts can be made large. Consequently, in spite of small-sized switch, wiring as well as electric insulating property and voltage-proof are comparatively improved.

In accordance with the present invention, since a cut-out is formed below a heart cam provided on a plunger, it is not necessary to insert the upper end of a hook pin into the heart cam by special means and the upper end of the hook pin can be automatically inserted into the heart cam. Therefore, in case where the switch is assembled or alternation of the switch types (for example, conversion of momentary type of switch into alternate type of switch) is made, there is an advantage that manufacturing steps can be remarkably decreased.

BRIEF DESCRIPTION OF THE DRAWINGS

The present invention will now be described in detail by reference to embodiments illustrated in the accompanying drawings in which:

FIGS. 3*a*, 3*b* and 3*c* are views for illustrating main portions of the present invention and for explaining one embodiment thereof, FIGS. 4*a* and 4*b* are views for explaining another embodiment according to the present invention.

DESCRIPTION OF THE PREFERRED EMBODIMENTS

Preferred embodiments of the present invention will be now described in detail with reference to the accompanying drawings.

Figure 1:
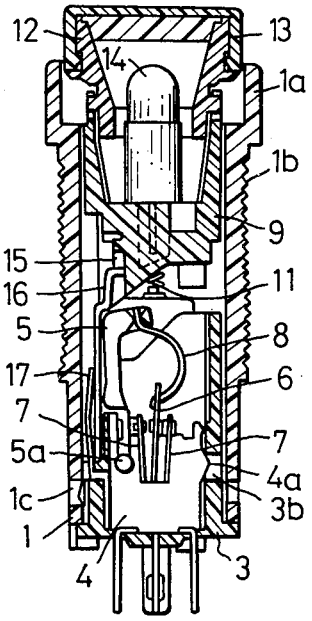
FIG. 1 is a centrally longitudinal cross-sectional view showing an embodiment of a small-sized push-button switch according to the present invention.
Figure 2:
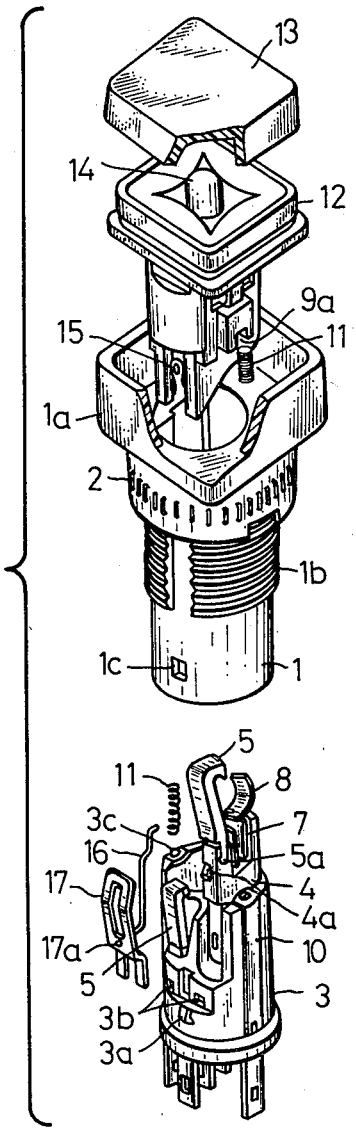
FIG. 2 is an exploded perspective view showing the embodiment of the small-sized push-button switch according to the present invention.

FIGS. 1 through 3 show a switch body indicated generally at reference numeral 1 of a small-sized push-button switch. The switch body 1 is formed at its upper portion with a jaw 1*a* and provided at its circumferential portion under the jaw 1*a* with a thread 1*b* which is engaged with a nut 2. A switch auxiliary base 3 is inserted in and attached to the switch body 1 at its bottom portion by projection-aperture connecting relationship between a projection 3*a* provided on the auxiliary base 3 and an aperture 1*c* formed on the switch body 1. In the embodiment, two switch bases 4 which constitute main members of the present invention are inserted in and attached to the auxiliary base 3 in juxtaposed relationship through projection-aperture connecting relationship between a projection 4*a* provided on the base 4 and an aperture formed on the auxiliary base 3.

As a switch actuating mechanism according to the present invention, fixed contacts and a movable contact of a so-called microswitch or switch block having a snapping action are vertically or axially disposed while the switching direction is lateral. More particularly, the switch base 4 is provided at one side thereof with a fulcrum 5*a* and is formed with an arm 5 which is swung about the fulcrum 5*a*. Moreover, disposed at the center of the switch base 4 are a movable contact 6 and fixed contacts 7 and 7′ which are equally spaced from the movable contact 6 at opposite sides thereof so that the lower portions of these contacts outwardly extend through the auxiliary base 3 as terminals. The terminal portions of the fixed contacts 7 and 7′ are outwardly folded relative to the terminal portion of the movable contact 6, that is, folded substantially at a right angle along the bottom surface of the switch base 4 and then further folded at a right angle relative to the bottom surface of the switch base 4 to be parallel to the terminal portion of the movable contact. Thus, spaces between the movable contact and the fixed contacts are made to be large. A resilient piece 8 which is made to be curved are connected between the upper portion of the arm 5 and the upper portion of the movable contact 6. The switch mechanism is of such a construction that the switching is made by pushing the resilient piece 8 in a direction and causing the contact point of the movable contact 6 to contact with either one of the fixed contact 7 and 7′. To summarize, the simple switching mechanism comprises the switch base 4, the arm 5, the movable contact 6, the fixed contacts 7 and 7′, and the resilient piece 8.

A plunger 9 which constitutes one of main portions of the present invention is inserted in the switch body 1 so as to be movable vertically therein above the arm 5. The plunger 9 is disposed inside the hollow upper portion of the switch body 1 and is held by a coil spring 11 which is loaded between a projection 3*c* for holding the upper end of a lamp circuit terminal 10 and an engaging portion 9*a* provided in a corresponding position relative to the plunger 9. At the same time, the plunger 9 is constructed so that it is slidable on the inner surface of the switch body 1 by depressing a push-button 13 mounted on a lamp holder 12. Disposed in the lamp holder 12 is a light emitting element 14 such as a light emitting diode, etc. Power is supplied to the light emitting element through the lamp circuit terminal 10 and the coil spring 11. Namely, the used coil spring 11 serves to restore the plunger 9 upwardly in an initial position after the plunger 9 is lowered by depression of the push-button 13 and then the depressing force is removed and simultaneously serves to constitutes a portion of the circuit through which a power is supplied to the light emitting element 14. This is one of the features of the present invention.

In operation, the push-button 13 is depressed in a condition as shown in FIG. 3*a* and then the plunger 9 which is formed at its bottom with inclined surface is lowered. Consequently, as shown in FIG. 3*b*, the inclined surface makes contact with the arm 5 to push the same in a righthand direction and simultaneously the movable contact 6 is rapidly pushed in the other direction to make contact with the other contact (the lefthand contact 7′ in FIG. 3*b*) due to the displacement of the curved resilient piece 8, and thereby making the opening and closing of the switch mechanism. When the depressing force against the push-button 13 is removed, the plunger 9 returns to its initial position due to the restoring force of the coil spring, and consequently the movable contact 6 is made away from the lefthand fixed contact 7′ to make contact with the righthand fixed contact 7 in its initial position.

Although the inclined surface of the plunger 9 may be made flat, it may be formed with a hook shaped portion 9*b* or a stepped portion adjacent the position where the movable contact is switched, as shown in FIGS. 3*a* and 3*b*. The formation of the stepped portion on the inclined surface has an advantage in that a lighter feeling for switch operation is generated since during switch operation, there is a phenomena that the switch operating force is abruptly made light by the switching of the movable contact after the switch operating force is temporarily made heavy in an intermediate position as shown in FIG. 3*c*.

Figure 5:
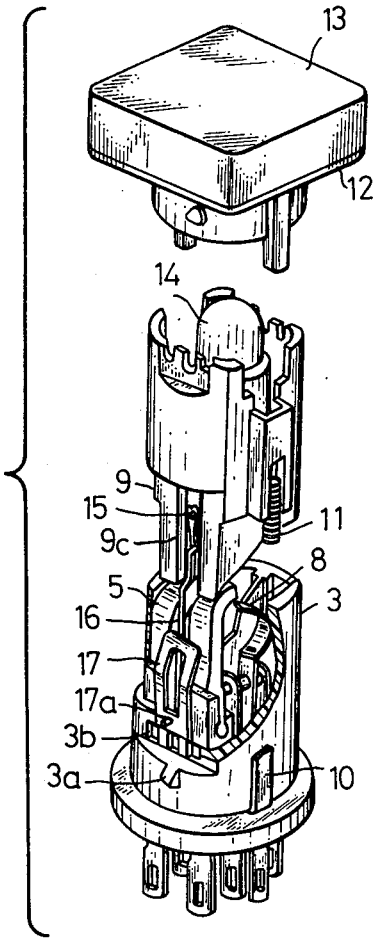
FIG. 5 is a partially exploded perspective view showing relationship between the switch mechanism and the plunger in case where the switch is made to be of an alternate type.

Although the above explanation is made about a momentary type of switch in which the present invention is embodied, an explanation about an alternate type of switch in which the present invention is embodied will be made. In the case of the alternate type of switch, a heart cam 15, a hook pin 16 and a resilient plate 17 are required in addition to the above-mentioned mechanism. As shown in Figures, particularly in FIGS. 4 and 5, the plunger 9 is formed at lower side thereof with a recess 9c in which the heart cam 15 is provided. The lower end of the heart cam is opened, that is cut to form a cut-out 15a so that the hook pin 16 can be easily and automatically inserted into the heart-cam position from the underside when the switch is assembled or the function or type of the switch is altered. As mentioned above, the hook pin 16 is engaged with the heart cam 15 and temporarily locks the movement of the plunger 9 each time the push-button 13 is depressed. Thus, the hook pin 16 serves to convert the momentary type of switch to the alternate type of the switch.

The hook pin 16 is formed to have their upper and lower ends folded in opposite directions as shown in FIG. 2. The resilient plate 17 which is curved to enhance its spring force is inserted into the apertures 3b provided on the switch auxiliary base 3 at its lower portion and clamped and fixed between the switch auxiliary base 3 and the switch base 4. The lower end of the hook pin 16 is inserted into the aperture 17a previously provided on the resilient plate 17 at the lower portion thereof and the upper end of the hook pin 16 is made to be engaged with the heart cam 15. The hook pin 16 is adapted to be movable in lefthand and righthand directions about its lower end inserted into the aperture 17a of the resilient plate as a fulcrum and to be slightly movable in a vertical direction. The resilient plate 17 always pushes the hook pin 16 from the side portion thereof so as to provide a smooth operation for the hook pin 16.

In operation, when the push-button 13 is depressed and released in a situation shown in FIG. 4a, the upper end of the hook pin 16 upwardly slides on the lefthand cam surface of the heart cam 15 and then is engaged within the upper recess 15b of the heart cam, as shown in FIG. 4b. At the time, the movable contact 6 is moved away from the righthand fixed contact 7 and switched over to the lefthand fixed contact 7'. The cam surface of the heart cam is adapted to have five stepped portions and when the upper end of the hook pin 16 is engaged within the recess 15b, the upper end of the hook pin 16 cannot be easily escaped from the recess 15b unless the push-button 13 is operated. Then, when the push-button 13 is depressed and released, the upper end of the hook pin 16 is escaped from the recess 15b, then downwardly slides on the righthand cam surface of the heart cam 15, and finally stops at the lower end of the heart cam 15, that is, the uppermost portion of the cut-out 15a, as shown in FIG. 4a. At the time, the movable contact 6 is caused to return to its initial position to be in contact with the righthand fixed contact 7, as shown in FIGS. 1 and 3a. Thus, the lefthand cam surface is provided with a big stepped portion so that when the push-button 13 is depressed in a situation shown in FIG. 4b, the upper end of the hook pin 16 is not directed toward the lefthand direction, but directed toward the righthand direction. The cam surface from the recess 15b to the lower end through the righthand cam surface is formed to ascend. The cam surface from the lower end to the recess 15b through the lefthand cam surface is also formed to ascend. Consequently, the cam surface is of such a construction that the upper end of the hook pin 16 always runs clockwisely.

When the hook pin 16 and the resilient plate 17 are removed out, the alternate type of switch is, of course, converted into the above-mentioned momentary type of switch.

Since the switch according to the present invention is constructed as described above, when the switch auxiliary base 3 into which the switch mechanism, the hook pin 16 and the resilient plate 17 are incorporated is inserted into the switch body 1 from the underside, the upper end of the hook pin 16 is automatically inserted into the heart cam 15 without necessity of any special means for inserting the upper end of the hook pin 16 into the heart cam. This is because the cut-out 15a is formed below the heart cam 15 provided on the plunger 9. Therefore, in accordance with the present invention, there is an advantage in that manufacturing steps are comparatively decreased when the switch is assembled or when the types of switches are altered, for example, the momentary type of switch is converted into the alternate type of switch. Furthermore, if the cut-out 15a formed on the lower end of the heart cam is formed to be divergent so as to open downwardly, it is also advantageous to insert the hook pin more easily when assembled.

As mentioned above, since the hook pin 16 and the resilient plate 17 are vertically or axially disposed, it is simple to mount these members on the switch. Furthermore, since the heart cam 15 is provided within the recess 9c of the plunger 9, and at the same time the resilient plate 17 and the hook pin 16 are disposed in the aperture 3b and the longitudinal groove 3d of the switch auxiliary base 3, respectively, the outer diameter or width of the switch can be made to be very small in manufacture in spite of the locked switch having a snap action during the opening and closing operations. This results in a push-button switch with its cylindrical body being very small compared with conventional ones.

Although the two microswitches are juxtaposed in the above-mentioned embodiments, only one microswitch or more than three microswitches may be used.

Although, as explained above, the switch is of such type that the switch body is provided at its circumferential surface with the thread which is engaged with the nut and through the nut the switch is attached to the panel by clamping, the switch may be constructed to be of a one-touch mounting type by providing a leaf spring on the outer surface of the switch body.

In case where a mounting opening for switch is formed on the panel of instrument, a circular opening is easier to be provided than a rectangular opening. Therefore, in this connection, the present invention is made on the point that the switch body including track shaped apertures is formed to be cylindrical.

Though the present invention has thus been described with reference to some preferred embodiments thereof, the embodiments are merely illustrative but in no way restrictive. Hence, various changes and modifications could be made by those skilled in the art without departing from the scope of the present invention.

What is claimed is:

1. A small-sized push-button switch which comprises:

at least one switch mechanism, each including a movable contact, fixed contacts disposed on opposite sides of the movable contact, a switch base for holding the lower portions of the movable contact and fixed contacts, an arm extending upwardly and being swung about one side portion of the switch base as a fulcrum and a resilient piece provided between the arm and the movable contact, a switch auxiliary base for holding the switch mechanism therein, a plunger having a push-button provided at the top and an inclined surface provided on the bottom thereof said plunger disposed on the arm so that the inclined surface of the plunger is slidable on the outer top surface of the arm, said plunger causing the arm to be swung in a direction by depression of the push-button and causing the movable contact to be moved in the other direction due to the action of the resilient piece whereby a switching operation is made, the direction of movement of the plunger, the movable contact and fixed contacts being disposed vertically, a heart cam formed on one side of the plunger for the heart cam being provided under the lower portion thereof with a cut-out, a resilient plate attached to the switch auxiliary base disposed below the plunger and provided with an aperture, and a hook pin adapted to be pushed toward the heart cam from the outside and folded at upper and lower ends in opposite directions, one end of the hook pin being inserted into the aperture of the resilient plate to form a fulcrum and the other end of the hook pin being engaged with the heart cam through the cut-out, the positions where the heart cam and the hook pin are disposed being made as a recess whereby said plunger maybe latched in a depressed position by said cam and pin.

2. A switch as set forth in claim 1, wherein the switch mechanism is inserted into the switch auxiliary base from the upperside, and the movable contact and the fixed contacts are adapted to outwardly extend through the auxiliary base.

3. A switch as set forth in claim 1 wherein the terminal portions of the fixed contacts are outwardly folded along the bottom surface of the switch base to provide large distances between the movable contact and the fixed contacts.

4. A switch as set forth in claim 1 wherein the plunger has a stepped portion at its inclined surface.

5. A switch as set forth in claim 1 wherein a light emitting element is provided within the push-button and the switch base, the switch auxiliary base and the switch base are mounted in projection-aperture relationship with one another to be assembled.

6. A switch as set forth in claim 5 wherein a spring is provided between the upper portion of the auxiliary base and the plunger for restoring the plunger to its initial position and serves as a portion of an electric circuit for supplying a power to the light emitting element.

7. A switch as set forth in claim 1 wherein the switch auxiliary base connected to the switch mechanism is inserted into the hollow cylindrical switch body from the underside.

8. A switch as set forth in claim 1 wherein the switch body is made to be cylindrical.

9. A switch as set forth in claim 1 wherein a groove is provided under the heart cam to facilitate assembly of the switch.

* * * * *